United States Patent [19]

Castelluzzo

[11] Patent Number: 4,858,319

[45] Date of Patent: Aug. 22, 1989

[54] APPARATUS FOR ENSURING THAT A KNIFE IS OPENED IN A DESIRED ORIENTATION

[75] Inventor: James Castelluzzo, New York, N.Y.

[73] Assignee: Unique Knife Manufacturing Corp., Roselle, N.J.

[21] Appl. No.: 118,627

[22] Filed: Nov. 9, 1987

[51] Int. Cl.[4] ..... B25F 3/00

[52] U.S. Cl. ..... 30/125; 30/86

[58] Field of Search ..... 30/40, 86, 125, 84, 30/40.2

[56] References Cited

U.S. PATENT DOCUMENTS 2,413,082 12/1946 Skaer ..... 30/125 UX 4,606,122 8/1986 Ullmann et al. ..... 30/43.92

*Primary Examiner*—Douglas D. Watts

*Attorney, Agent, or Firm*—Lerner, David, Littenberg, Krumholz & Mentlik

[57] ABSTRACT

A knife includes a blade reservoir and a sleeve slidable onto the knife to cover the reservoir. A latch prevents removing the sleeve unless depressed. The latch is located in a position requiring the knife to be turned into a position facing the blade reservoir upward before it can be actuated. In this manner, the blade reservoir must face upward when the sleeve is removed and accidental dropping of blades from the reservoir during opening is prevented.

4 Claims, 5 Drawing Sheets

APPARATUS FOR ENSURING THAT A KNIFE IS OPENED IN A DESIRED ORIENTATION

BACKGROUND OF THE INVENTION

The present invention relates to knives and, more particularly, to knives of a type having a reservoir of blades for replacement of an active blade.

In my prior co-pending application, Ser. No. 894,676, I disclose a utility knife made up of two mating halves held together by a sleeve slipped over the exterior of the two halves. One of the halves includes a blade reservoir for receiving a supply of replaceable blades. The reservoir is normally covered by the sleeve. The disclosed knife includes means for feeding the blades, one at a time, from the reservoir to an active position. It also includes means for releasing a blade from the active position for discard.

When the reservoir is empty, it may be replenished by sliding the sleeve off the two halves and installing a fresh supply of blades.

The possibility exits that a user may slide the sleeve off the two halves while the reservoir still contains blades. If the half containing the reservoir faces downward, the blades in the reservoir may drop out. Some types of blades have sharp points and/or edges which could damage objects if they should fall from the knife. It is thus undesirable to permit the sleeve to be removed when the half containing the reservoir faces downward.

OBJECTS AND SUMMARY OF THE INVENTION

It is an object of the invention to provide a knife which overcomes the drawbacks of the prior art.

It is a further object of the invention to provide a knife including means for ensuring that the knife is turned to a desired orientation before it can be opened.

It is a still further object of the invention to provide a knife of a type having a mated pair of halves held assembled by a sleeve thereon, and means for ensuring that the knife is rotated into a desired rotation before the sleeve can be removed.

It is a still further object of the invention to provide a knife of a type having a mated pair of halves held assembled by a sleeve thereon. One of the halves includes a blade reservoir covered by the sleeve. Means are provided to ensure that the half containing the blade reservoir faces upward before the sleeve can be removed to reveal the blade reservoir.

Briefly stated, the present invention provides a knife of a type having a blade reservoir and a sleeve slidable onto the knife to cover the reservoir. A latch prevents removing the sleeve unless the latch is depressed. The latch is located in a position requiring the knife to be turned into a position facing the blade reservoir upward before the latch can be actuated. In this manner, the blade reservoir must face upward when the sleeve is removed and accidental dropping of blades from the reservoir during opening is prevented.

According to an embodiment of the invention, there is provided a knife comprising: a body, a blade reservoir in the body, the blade reservoir being adapted for containing at least one blade, the blade reservoir having an opening to a surface of the body through which blades may be inserted, a sleeve, means for permitting the sleeve to slide onto the body and thereby to cover the opening, whereby the blades are retained in the reservoir, a latch in the body, the latch including means for preventing the sleeve from being removed from the opening, and the latch is positioned on the body in a position requiring tee body to be turned with the opening substantially uppermost in order to permit release of the latch, whereby falling of the blades from the reservoir when the sleeve is removed is prevented.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
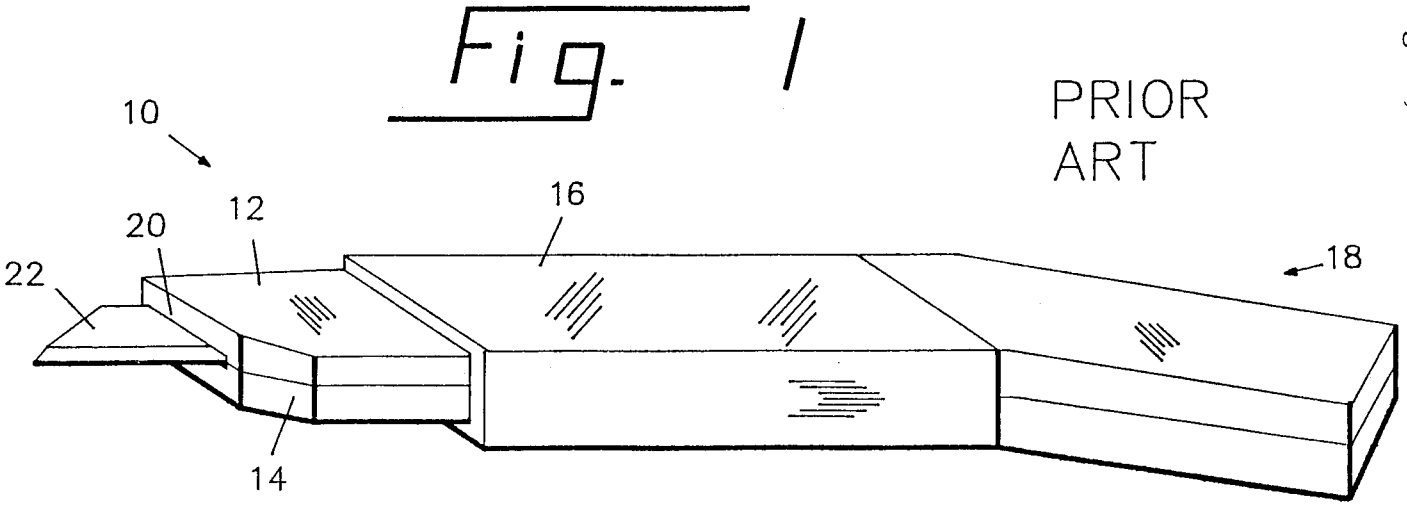
PRIOR ART Fig. 1
FIG. 1 is a perspective view of a utility knife according to my the prior copending patent application.

Referring to FIG. 1, there is shown, generally at 10, a utility knife according to my referenced co-pending patent application. This drawing is labelled "PRIOR ART" solely because of my prior disclosure and such labelling contains no admission that utility knife 10 is prior art for any other reason.

A body consisting of first and second halves 12 and 14 are held in the assembled condition shown by a sleeve 16 slipped thereon. A handle 18 is made up of extensions of halves 12 and 14 beyond sleeve 16. A blade slot 20 in an end of utility knife 10 permits a blade 22 to protrude into its operational position therethrough.

The control of blade 22 and its replacement and removal are fully covered in my co-pending patent application and such details form merely a background for the present invention. Accordingly, internal details of utility knife 10 are omitted.

Figure 2:
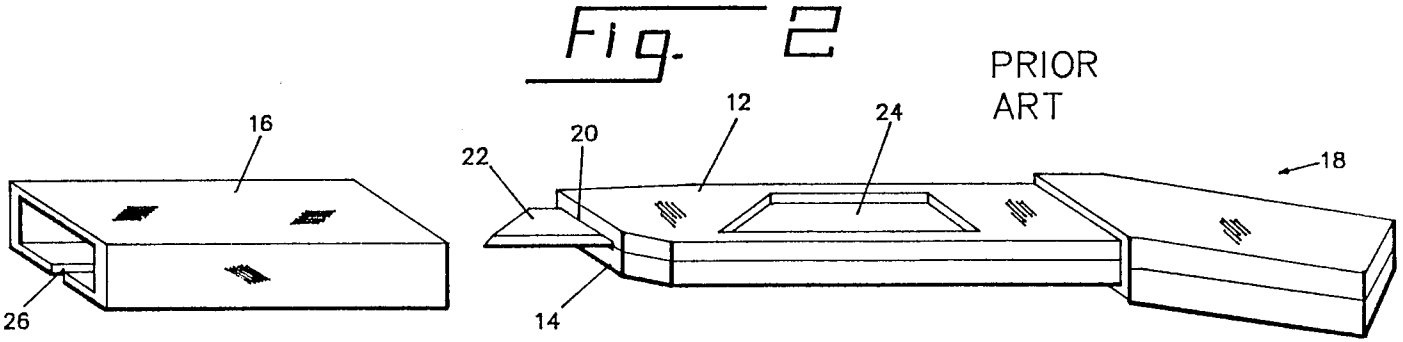
FIG. 2 is a perspective view of the utility knife of FIG. 1 with the retaining sleeve slid off to reveal a blade resevoir in one of the halves.

Referring now to FIG. 2, sleeve 16 is removed from halves 12 and 14 to reveal a blade reservoir 24 in half 12. It is assumed that half 14 does not include a blade reservoir 24. A supply of blades 22 may be placed in blade reservoir 24 for use as blade 22 in the operational position becomes dull and is replaced. Sleeve 16 includes a slot 26 which engages an unseen boss on the hidden side of half 14. The requirement for fitting slot 26 over the boss prevents the side of sleeve 16 having slot 26 therein from being assembled in the improper upper position in FIG. 2.

It would be clear to one skilled in the art that, when sleeve 16 is slipped off halves 12 and 14, it is desirable that blade reservoir 24 be facing upward. This is especially so if blade reservoir 24 still contains blades at that time. If sleeve 16 is slipped off when blade reservoir 24 faces downward, the free blades 22 in blade reservoir 24 could fall therefrom and could cause damage or injury. However, there are insufficient clues in the apparatus of FIGS. 1 and 2 to warn a user that blade reservoir 24 faces downward until sleeve 16 is slipped free. By then, of course, it is too late.

Figure 3:
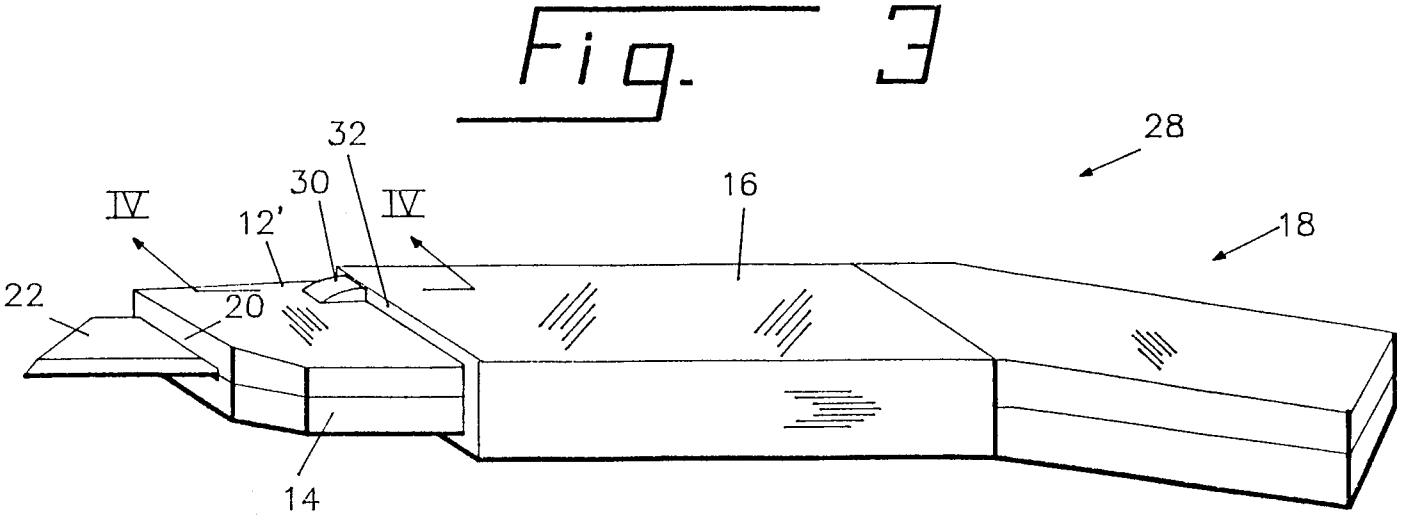
FIG. 3 is a perspective view of a utility knife according to an embodiment of the invention.

Referring now to FIG. 3, a utility knife 28 according to the present invention includes mating halves 12′ and 14. A sleeve 16 holds halves 12′ and 14 in their assembled condition. A latch 30 is resiliently urged upward in a position adjacent a forward surface 32 of sleeve 16. In the condition shown, sleeve 16 cannot be slipped off halves 12′ and 14.

Figure 4:
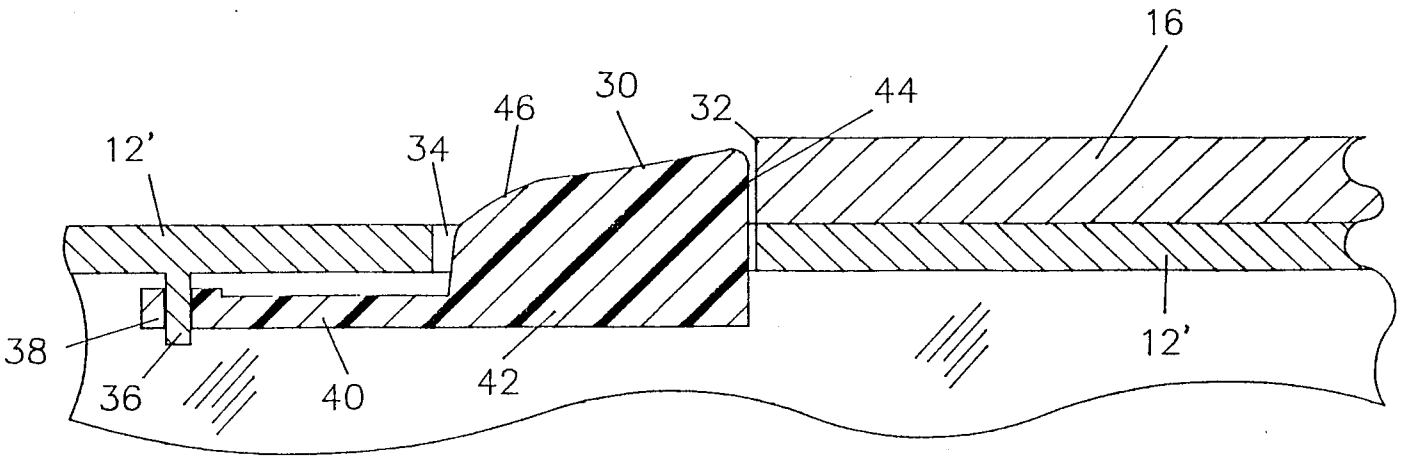
FIG. 4 is a cross section taken along IV—IV in FIG. 3.

Referring now to FIG. 4, half 12′ includes an opening 34 just forward of forward surface 32 of sleeve 16. A boss 36, extending inward from half 12′, is engaged by an attachment sleeve 38 of latch 30. A resilient bar 40 connects attachment sleeve 38 to a locking button 42 extending upward through opening 34, thereby placing an abutment surface 44 into a blocking position to engage forward surface 32 in the event that it is attempted to remove sleeve 16 in the condition shown. An upper surface 46 of locking button 42 is sloped upward from left to right in the figure to permit sleeve 16 to slide thereover in moving from left to right by depressing locking button 42 into opening 34 until forward surface 32 passes abutment surface 44. Then, locking button 42 is urged upward into the locking position shown by resilient bar 40.

Figure 5:
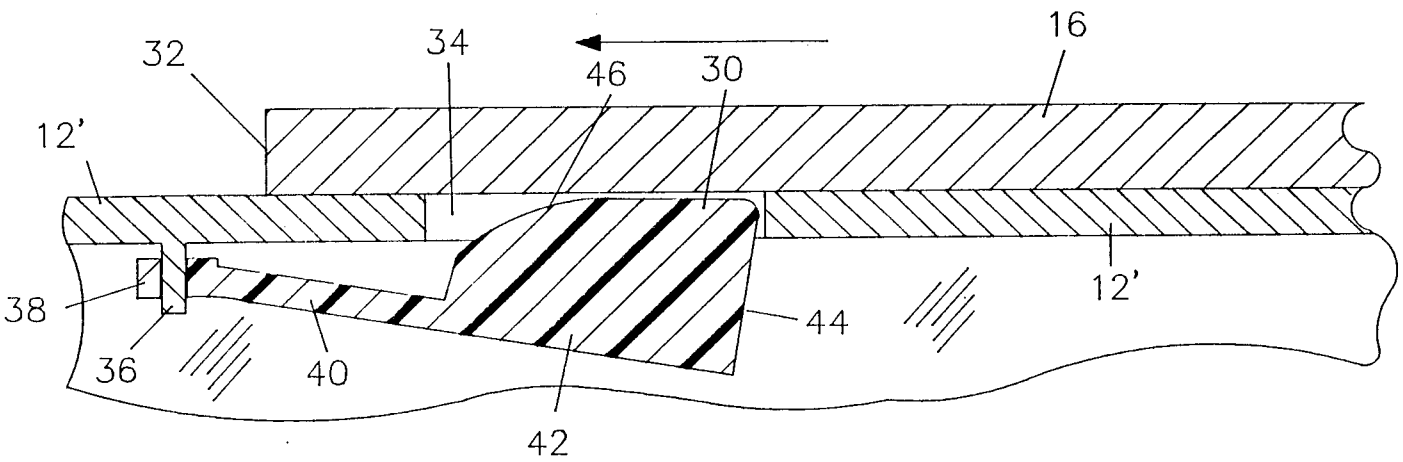
FIG. 5 is a cross section corresponding to FIG. 4 showing the sleeve partly removed.

Referring now to FIG. 5, sleeve 16 is removed by manually depressing locking button 42 into opening 34 until abutment surface 44 is out of engagement with forward surface 32. Then, sleeve 16 may be started sliding toward the left into the released condition. Locking button 42 is held in the depressed condition shown until sleeve 16 is free thereof. Once sleeve 16 is free of locking button 42, locking button 42 is urged resiliently into its extended position, corresponding to its position in FIG. 4.

Returning now to FIG. 3, it will be noted that latch 30 is relatively small and does not extend significantly above the adjacent surface of sleeve 16. Accordingly, release of sleeve 16 requires that utility knife 28 be rotated into a position where latch 30 can be seen and operated. This, in turn, requires that latch 30 be in an uppermost position. When latch 30 is in the uppermost position, blade reservoir 24 (FIG. 2) is also in the uppermost position. Accordingly, the object of the invention to require a user to turn utility knife 28 into an orientation placing blade reservoir 24 uppermost before removing sleeve 16 is accomplished. With blade reservoir 24 in the desired uppermost position, blades 22 which may be remaining in blade reservoir 24 remain therein and do not fall out to cause damage.

One skilled in the art would recognize that the present invention is not limited to a utility knife held assemble by a sleeve. Embodiments of the invention wherein a knife has a body made up of a different number of pieces with a blade reservoir facing in a predetermined direction should also be considered to fall within the ambit of the invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A knife comprising a longitudinally extended elongated knife body including a first longitudinally extending surface and a second longitudinally extending surface opposite from said first longitudinally extending surface, a blade reservoir in said knife body for receiving at least one blade and including an opening on said first longitudinally extending surface of said knife body through which said at least one blade may be inserted, sleeve means slidably disposed on said knife body, whereby said sleeve means may be slidably displaced over said knife body into a predetermined location on said knife body covering said opening so as to prevent said at least one blade from being removed therefrom, and latch means projecting from said first longitudinally extending surface of said knife body, said latch means being movable between a first normal operating position and a second position whereby when said latch means is in said first normal operating position with said sleeve means located at said predetermined location, said latch means prevents removal of said sleeve means from said knife body, and when said latch means is in said second position, said sleeve means is slidably displaceable from said predetermined location and can be removed from said knife body, whereby operation of said latch means with said first longitudinally extending surface of said knife body facing upwardly causes said opening to face upwardly thereby preventing said at least one blade from falling from said reservoir upon removal of said sleeve means.

2. The knife of claim 1 wherein said knife body comprises first and second mating knife body portions, whereby displacement of said sleeve means over said knife body retains said first and second mating body portions in mating condition.

3. The knife according to claim 1 wherein said first longitudinally extending surface of said knife body includes a latch opening, said latch means extending through said latch opening so as to provide an abutment surface adjacent to said sleeve means when said sleeve means is located at said predetermined location.

4. The knife according to claim 3 wherein said latch means includes urging means resiliently urging said latch means into said first normal operating position, whereby said latch means is moved into said second position by pushing against said urging means.

* * * * *